US010603550B1

(12) United States Patent
Fultz

(10) Patent No.: US 10,603,550 B1
(45) Date of Patent: Mar. 31, 2020

(54) HANDHELD PROPULSION UNIT FOR USE BY A USER IN AND UNDER WATER

(71) Applicant: Charles Fultz, Fort Lauderdale, FL (US)

(72) Inventor: Charles Fultz, Fort Lauderdale, FL (US)

( * ) Notice: Subject to any disclaimer, the term of this patent is extended or adjusted under 35 U.S.C. 154(b) by 0 days.

(21) Appl. No.: 16/230,409

(22) Filed: Dec. 21, 2018

(51) Int. Cl.
*A63B 35/12* (2006.01)
*A63B 35/10* (2006.01)

(52) U.S. Cl.
CPC ..... *A63B 35/12* (2013.01); *A63B 35/10* (2013.01); *A63B 2208/03* (2013.01); *A63B 2225/60* (2013.01); *A63B 2244/203* (2013.01)

(58) Field of Classification Search
CPC ..... A63B 35/12; A63B 35/10; A63B 2208/03; A63B 2225/60; A63B 2244/203
See application file for complete search history.

(56) References Cited

U.S. PATENT DOCUMENTS 4,996,938 A * 3/1991 Cameron ..... A63B 35/12 114/315
5,105,753 A * 4/1992 Chih ..... A63B 35/12 114/315
5,158,034 A * 10/1992 Hsu ..... A63B 35/12 114/315
2010/0212571 A1* 8/2010 White ..... A63B 35/12 114/315

* cited by examiner

*Primary Examiner* — Stephen P Avila

(57) ABSTRACT

A handheld propulsion unit for use by a user in and under water is disclosed. The handheld propulsion unit includes a tubular shaped housing assembly having a forward and rearward end. A channel defined by the tubular shaped housing assembly allows a flow of water to move through the tubular shaped housing assembly. At least one frame member connected to the tubular shaped housing attaches an electric motor within the channel such that the electric motor is coaxially aligned with the channel. A propeller coaxially coupled directly to a rotating part of the electric motor eliminates a drive transfer assembly or a drive transfer housing from spanning the channel. Hand grips on the tubular shaped housing assembly are configured for being held by the user and allowing the user to maneuver a thrust provided by the flow of water through the channel when the propeller is operating.

19 Claims, 9 Drawing Sheets

HANDHELD PROPULSION UNIT FOR USE BY A USER IN AND UNDER WATER

CROSS-REFERENCE TO RELATED APPLICATIONS

This application claims the benefit of the filing date of U.S. Provisional Application Ser. No. 62/741,599 titled "HANDHELD PROPULSION UNIT FOR USE BY A USER IN AND UNDER WATER" and filed Oct. 5, 2018 and the subject matter of which is incorporated herein by reference.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the propulsion units for use by divers, swimmers and snorkelers underwater.

BACKGROUND

Many people enjoy swimming, snorkeling and scuba diving. Being underwater and near the water provides many people relaxation and physical activity. Many people who enjoy swimming, snorkeling and scuba diving have also begun to use underwater and water propulsion units for moving a person faster through the water than if they were swimming, scuba diving or snorkeling using only human power. However much of the prior art underwater propulsion units have many disadvantages.

First, many propulsion vehicles have objects in front of the path of the blades of the propeller that substantially interrupt the flow of water to the propeller thereby decreasing the efficiency of the motor. For example, United States Patent Application Serial No. 2010/0212571 assigned to Mayhem UK Limited ("Mayhem") teaches a handheld propulsion unit with the motor located within a housing outside of a channel and a belt and housing in front of the channel allowing the drive produced by the motor to be transferred so that a propeller located within the channel may rotate. When the flow of water to the propeller is obstructed, the efficiency of the motor is greatly decreased. Thus, the drive transfer assembly and drive transfer casing or housing disclosed by Mayhem is very inefficient, noisy, heavy and as a result not cost effective.

Second, other propulsion units include gearing or gears that also decrease the efficiency of the motor. These types of units requiring gears are the result of having to properly fully encase and waterproof the motor from being exposed to water and other types of impurities. The units that require gears decrease the efficiency of the motor. In some embodiments, such as taught by United States Patent Application Serial Number 2010/0212571 to White et al. ("White reference"), the efficiency of the motor is decreased because of the gearing. The propulsion unit taught by the White reference includes gearing that decreases the efficiency of the motor. Additionally, propulsion unit taught by the White reference has a large housing encasing the gears in addition to the ribbing that interrupts the flow of water to the propeller which also decreases the efficiency of the propulsion unit.

As a result, there exists a need for improvements over the prior art a more efficient propulsion unit for use by divers, swimmers and snorkelers.

SUMMARY

A handheld propulsion unit for use by a user in and under water and methods for propelling a user through water are disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope. In one embodiment, a handheld propulsion unit for use by a user in and under water is disclosed. A handheld propulsion unit includes a tubular shaped housing assembly having a forward end and an opposing rearward end. A channel defined by the tubular shaped housing assembly allows a flow of water to move through the tubular shaped housing assembly. At least one frame member connected to the tubular shaped housing assembly attaches an electric motor within the channel such that the electric motor is coaxially aligned with the longitudinal axis of the channel. A propeller coaxially coupled directly to a rotating part of the electric motor eliminates at least a drive transfer assembly or a drive transfer housing within or in front of the channel. The tubular shaped housing assembly includes hand grips on the sides of the tubular shaped housing assembly. The hand grips are configured for being held by the user and allowing the user to maneuver a thrust provided by the flow of water through the channel when the propeller is operating.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
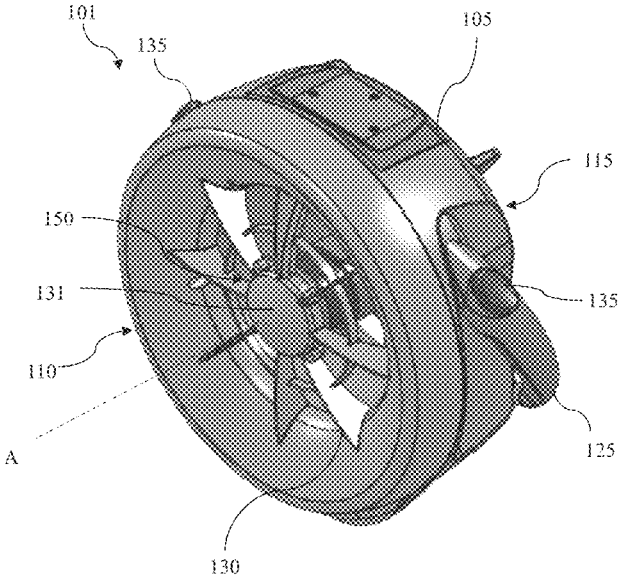
FIG. 1 is a front perspective view of a handheld propulsion unit for use by a user in and under water, according to an example embodiment.
Figure 2:
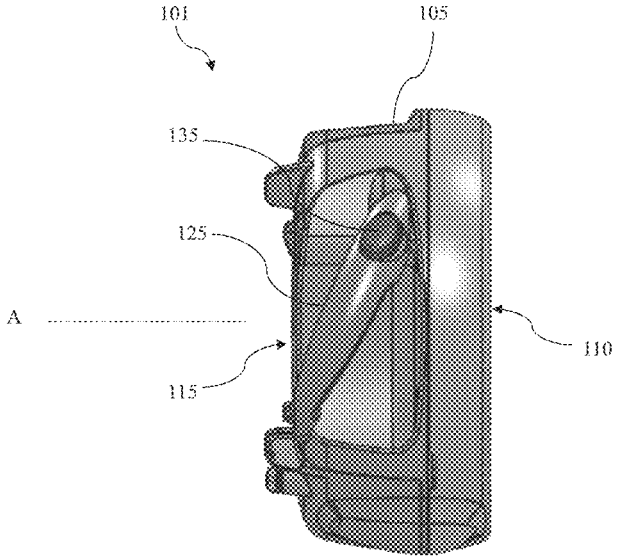
FIG. 2 is a side view of the handheld propulsion unit for use by a user in and under water, according to an example embodiment.
Figure 3:
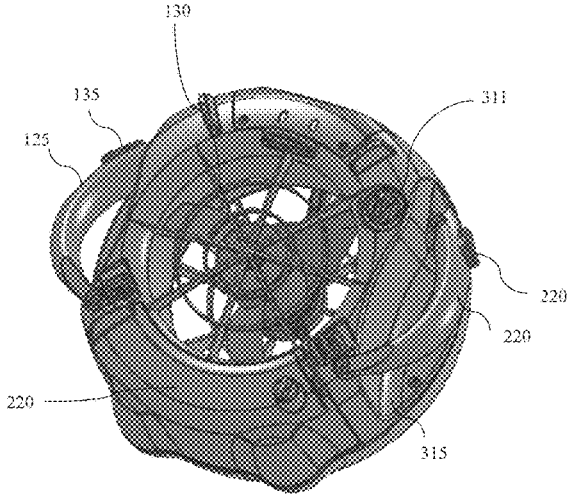
FIG. 3 is a first rear perspective view of the handheld propulsion unit for use by a user in and under water, according to an example embodiment.
Figure 4:
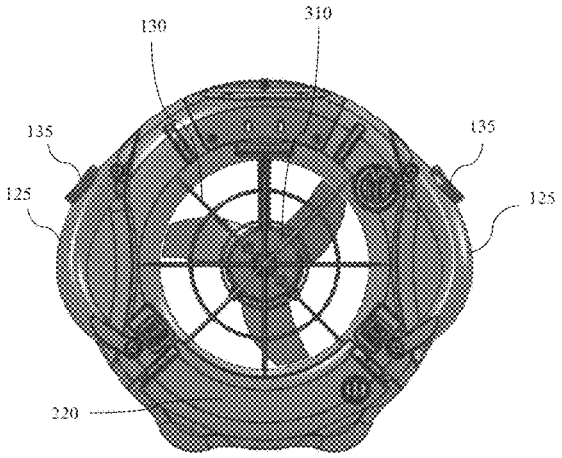
FIG. 4 is a rear view of the handheld propulsion unit for use by a user in and under water, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a handheld propulsion unit that has an electrical motor positioned within channel provided by a tubular shape housing assembly. The electrical motor is positioned such that the rotating element of the electrical motor is coaxially aligned with the longitudinal axis of the channel. In one embodiment, the electrical motor also is positioned between the forward end and rearward end of the tubular shaped housing assembly. In some embodiments, the electrical motor may also be fully within the channel, which may provide a greater cooling effect on the electric motor. These disclosed embodiments improve over the prior art by not requiring gears and having the rotating element of the motor directly connected with the propeller within the channel. The disclosed embodiments improve over the prior art by having the flow of water through the channel that contacts the electrical motor and providing a cooling effect on the electrical motor. This is an improvement over the prior art because previously the units taught by the prior art had overheating issues. Additionally, the present invention improves over the prior art by providing a channel having a substantially uninterrupted intake flow path for water flowing into the channel except for a frame element configured to connect the motor within the channel. This improves over the prior art by providing a more efficient motor. The present embodiments also improve over the prior art by eliminating drive transfer assembly or drive housing spanning a front or forward end of the channel. Essentially, the present methods and apparatus improve over the prior art by achieving speeds that are faster than traditional systems, while reducing weight and reducing size of the unit required to do so. The present invention, that eliminates all gears and places the battery system within the outer structure of the unit. The system improves performance, extends run-time, reduces overall size, eliminates excess weight and noise from the system, enhances reliability, increases hydrodynamics, and affords unprecedented maneuverability. A unique battery system allows users to change batteries in less than 10 seconds and provides virtually unlimited run-time. Additionally, the present invention improves over the prior art by having a removable battery power source in electrical communication with the electrical motor that is housed in the tubular shape housing assembly.

Referring to FIGS. 1-6, a handheld propulsion unit 101 for use by a user in and under water. Additionally, a specific figure will be referred to if a component is more easily or illustrated on that specific figure. The term "user" used throughout this application will mean a person who is a swimmer, snorkeler, or scuba diver. The handheld propulsion unit has a tubular shaped housing assembly 105 having a forward end 110 and an opposing rearward end 115. The tubular shape housing may comprise material such as molded plastics (for example, acrylonitrile-butadiene-styrene, otherwise known as ABS). However other material may be used that are within the spirit and scope of the present invention. The tubular shaped housing assembly may be formed from a single piece or from several individual pieces joined or coupled together. The components of the tubular shaped housing assembly may be manufactured from a variety of different processes including an injection molding extrusion process, a mold, welding, shearing, punching welding, folding etc. The tubular shaped housing assembly may also include cavities configured for receiving electrical components and may also be formed by multiple hollow pieces joint together so that electrical circuitry may be housed within the tubular shaped hosing assembly.

A channel 150 is defined by the tubular shaped housing assembly for allowing a flow of water to move through the tubular shaped housing assembly. The channel has a forward end at the forward end of the tubular shaped housing assembly and a rearward end at the rearward end of the tubular shaped housing assembly. In the present embodiment, the channel defines a circular shaped channel, however it is understood that other shapes may be defined by the housing assembly that are within the spirit and scope of the present embodiment. The channel 150 has a longitudinal axis does represented by hashed line A in FIG. 2 and FIG. 5A.

The body of the tubular shaped housing assembly may be hollow inside or may have cavities therein which are configured for housing various components for providing electrical energy to the motor, such as a battery or removable battery, electrical circuitry, processors, etc. For example, in the present embodiment the rearward end of the housing has a cavity defining a space to house the battery that is covered by a lockable door 220 (illustrated in FIGS. 3 and 4).

At least one frame member 130 is connected to the tubular shaped housing and is configured for attaching an electric motor within the channel 150 such that the electric motor is coaxially aligned with the channel. In the present embodiment, the frame member are elongated shaped ribs or ribbing spanning both the forward end and rearward end of the channel. The frame members may comprise of material such as polycarbonates, such as Acrylonitrile butadiene styrene (ABS plastic), Lexan™, and Makrolon™. However other types of materials may be used and are within the spirit and scope of the present invention. The frame members may be formed from a single piece or from several individual pieces joined or coupled together. The components of the frame members may be manufactured from a variety of different processes including an extrusion process, injection molding, a mold, welding, shearing, punching welding, folding etc. The frame member may prevent items from entering the path of the rotating propeller blade.

Figure 5:
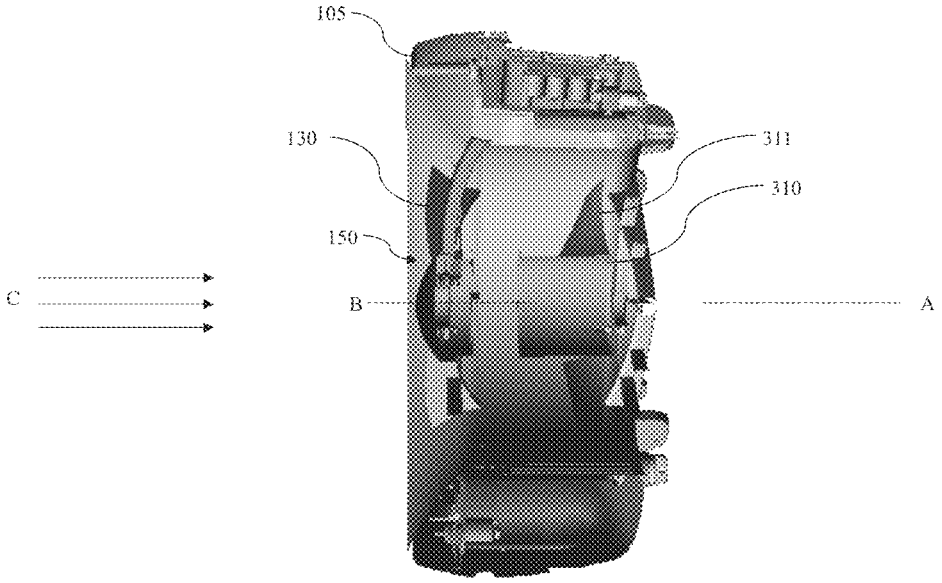
FIG. 5 is a side partial cross-sectional view of the handheld propulsion unit for use by a user in and under water partially illustrating components of the handheld propulsion unit, according to an example embodiment.
Figure 5A:
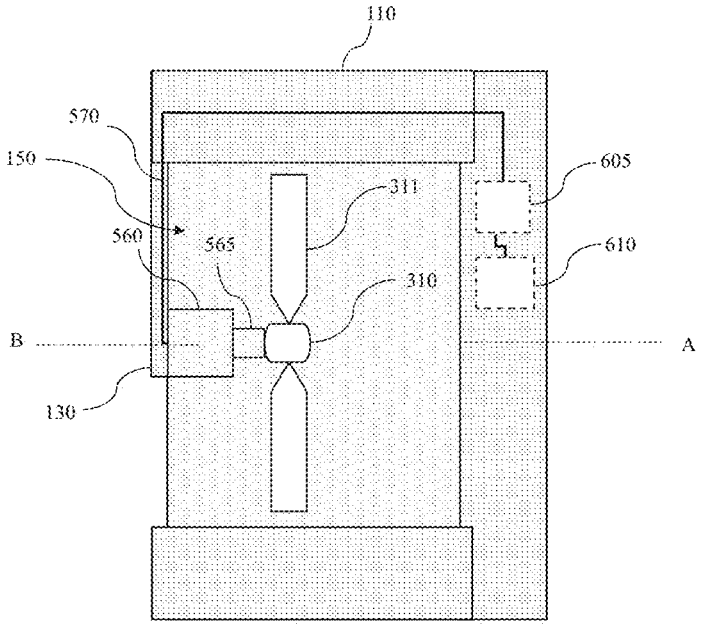
FIG. 5A is a block diagram, from the a side cross-sectional view, illustrating main components of handheld propulsion unit, including a propeller coaxially coupled directly to a rotating part of an electric motor thereby eliminating at least one of a drive transfer assembly and a drive transfer housing within the channel, according to an example embodiment.

The electrical motor 604 is positioned such that the stationary element 560 of the electrical motor is attached to the frame element or ribbing and the rotating element 565 of the electrical motor rotates along the longitudinal axis of the motor (which is represented by hashed line B in FIG. 5A). The electrical motor may be encased in a housing such that it is waterproofed and water, as it throws through the channel, directly contacts the electrical motor housing and a cooling effect on the electrical motor. In operation, as the rotating element of the electrical motor rotates, the propeller rotates forcing water to flow through the channel (in the direction of arrowed lines C as illustrated in FIG. 5) from in front of the forward end of the tubular shape housing assembly through the channel and out past the rearward end of the tubular shaped body. The force provided by the water moving through the channel provides a forward force on the propulsion unit propelling the unit and anything attached to the unit in a direction opposing the direction of the water moving through the channel. Additionally, a removable battery power source 610 is in electrical communication with the electrical motor and is housed in the tubular shaped housing assembly.

A propeller 310 having blades 311 is coaxially coupled directly to a rotating part of the electric motor thereby eliminating at least one of a drive transfer assembly and a drive transfer housing from spanning a forward end of the channel. The propeller may vary from 3 blade propeller to 4 blade propeller and sometimes even 5 blade propeller. The propeller may comprise material such as polycarbonates, such as Acrylonitrile butadiene styrene (ABS plastic), Lexan™, and Makrolon™. However other types of materials may be used and are within the spirit and scope of the present invention. The propeller may be formed from a single piece or from several individual pieces joined or coupled together. The components of the propeller may be manufactured from a variety of different processes including an extrusion process, injection molding, a mold, welding, shearing, punching welding, folding etc.

Referring to FIG. 5A, which is a block diagram illustrating main components of the handheld propulsion unit, illustrates a propeller 310 coaxially coupled directly to a rotating part 565 of the electric motor thereby eliminating at least one of a drive transfer assembly or a drive transfer housing within the channel. In the present embodiment, a stationary portion 560 of the electric motor is attached to a frame member 130 within the channel 150. In one embodiment, as illustrated in FIGS. 5 and 5A, the electric motor is coaxially aligned with the channel and such that the entire electric motor may be between the forward end forward end and the rearward end of the tubular shaped housing. Additionally, the entire electric motor may also be inside the channel, which may provide an increased cooling effect if the motor was located in front of or outside of the channel.

As illustrate in FIG. 5, the propeller 310 is coaxially aligned with the channel, and positioned between the forward ribbing or frame element and rearward ribbing or frame element and coaxially aligned and coupled directly to a rotating part 565 of the electric motor thereby eliminating gearing. The use of the electric motor also eliminates gears by adjusting the amount of electrical energy provided by the battery power source 610 to the electric motor in order to control the amount of thrust produced by the propeller. Having the electric motor positioned within the channel and such that the rotating part of the motor is coupled directly to the propeller is an important feature for several reasons.

Having the electric motor positioned within the channel eliminates the need for gears increases the efficiency of the motor because less energy is lost because of not having gears, and it decreases the amount of parts that may fail within the handheld propulsion unit. Additionally, because the electric motor is positioned within the channel, the arrangement provides a substantially uninterrupted intake flow path for water flowing into the channel except for the frame elements and may also provide a greater cooling effect on the motor because of increased water flow on the electric motor or motor housing. As a result, positive hydrodynamics are increased because the present invention does not have gears, belts, belt housing or batteries in front of the intake water flow. This uninterrupted flow path increases the efficiency of the operation of the propulsion unit given that the water flow is optimized and allows for smooth or smoother water into the channel that interacts with the propeller without turbulence.

Some of the prior art devices have, in addition to the guards or devices for preventing items from entering into the channel, components in front of the channel that may cause turbulence and interrupt water flow into the channel. The more components in front of the channel, the greater the amount of the flow that is interrupted, which causes decreases in efficiency of the motor and overall operation of the unit. For example, the Mayhem reference teaches the use of a drive transfer housing that encases a belt or drive transfer system that is used to transfer the drive from the motor that is positioned within the housing outside the channel. In drive transfer assembly housed within the drive transfer housing taught by Mayhem is used for transmission of drive to the propeller from the motor may be via a belt drive, a chain-drive or a shaft, that extends substantially radially of the casing. The drive transfer assembly taught by Mayhem is very inefficient because the causing interrupts the water flow, which decreases the efficiency of the motor and overall performance of the unit. Having the electric motor within the channel provides an uninterrupted or substantially uninterrupted intake flow path for water flowing into the channel except for the at least one frame member when the propeller is operating.

Unlike the device taught by Mayhem, the present embodiments eliminate the need for a drive transfer assembly or drive transfer housing because the motor is coaxially aligned within the longitudinal axis of the channel the and having the rotating part of the motor coupled to the propeller. Additionally, unlike the device taught by Mayhem, the motor of the present invention is configured such that a stationary portion of the electric motor is attached to a frame member within the channel such that the flow of water through the channel contacts the electric motor and provides a cooling effect on the electric motor. This is also another important feature, the device taught by Mayhem specifically positions the motor outside of the channel to prevent overheating. The cooling effect on the motor may be defined as causing a heat produced by the motor to be transferred to the outside environment.

In the present embodiment, the multiple frame members 130 spanning the channel 150 are included on both the forward end of and rearward end of the channel. While only one frame member may be required, multiple frame members may be used for providing a guard or safety feature for preventing items from entering into the channel or for preventing injury due to the propeller.

The tubular shaped housing assembly also includes thereon hand grips 125 on opposing sides of an outward facing wall 315 of tubular shaped housing assembly. The hand grips are configured for being held by the user and allowing the user to maneuver a thrust provided by the flow of water through the channel when the propeller is operating. The propulsion unit is to be held with both hands by the diver. The hand-grips 125 are mounted opposite one another on the tubular shaped housing assembly 101. The hand-grips are inclined upwardly the front or forward end 110 of the unit so as to enable the swimming diver to hold the unit underwater with both hands forward and just below him/her keeping drag to a minimum and allowing the flow of water through the channel 150 unit to be unobstructed by the diver's body. Water is drawn into the forward end of the unit and forced rearwardly outward from the channel. Turning from forward propulsion is achieved simply by using the hands on the hand-grips to turn the to the required extent in the desired direction, and ascent or descent can be achieved likewise by inclining the unit up or down. The handgrips may comprise material such as polycarbonates, such as Acrylonitrile butadiene styrene (ABS plastic), Lexan™, and Makrolon™. However other types of materials may be used and are within the spirit and scope of the present invention. The hand grip may be formed from a single piece or from several individual pieces joined or coupled together. The components of hand grip may be manufactured from a variety of different processes including an extrusion process, injection molding, a mold, welding, shearing, punching welding, folding etc. A knob 135 protrudes from each handgrip and a second knob protrudes from the second handgrip, the first knob and second knob are configured for being engaged by the user.

Figure 6:
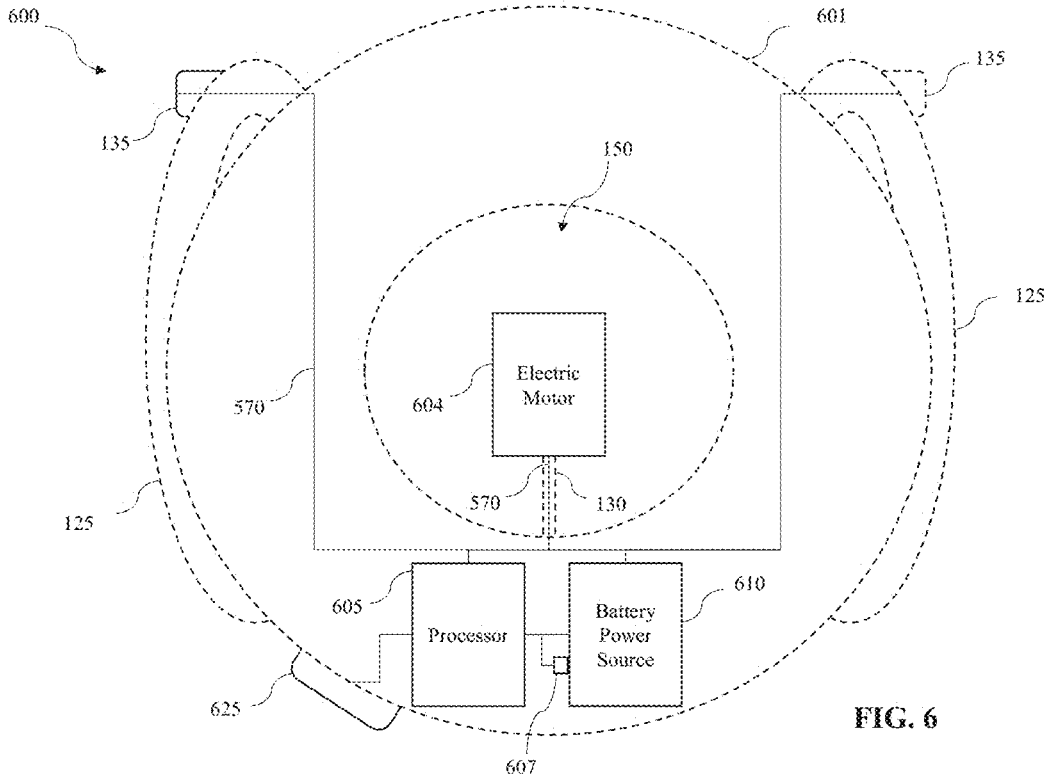
FIG. 6 is a block diagram illustrating the main electrical components of the handheld propulsion unit, according to an example embodiment.

Referring to FIG. 6, FIG. 6 is a block diagram illustrating the main electrical components of the hand prolusion unit relative to the tubular shaped housing, according to an example embodiment. In FIG. 6, the hashed line 601 refers to the tubular shaped housing assembly. The tubular shaped housing is further configured for housing electrical circuitry and a processor or central control unit 605 in electrical communication with the electric motor 604, the battery power source 610, sensor 707, knobs 615. While only the main electrical components are illustrated in FIG. 6, it is understood that other components may be in conductive communication with any component illustrated in FIG. 6. FIG. 6 also illustrates that only one frame member 130 or rib may be used to connect and position the motor 604 and propeller within the channel 150 such that the motor and propeller are coaxially aligned with the longitudinal axis of the channel. FIGS. 5A and. 6 also illustrates that the one frame member does not have to span the entire channel so that the least amount of interrupted water flow is caused by the spanning member. In both FIGS. 5A and 6, only one frame member 130 spans at most half of the channel. Additionally, the single frame member is narrowly tailored and configured to only receive electrical conductors or any other component for powering the motor and not for housing a drive transfer assembly or drive transfer housing. The Conductors 570 may be used to connect the electrical circuitry such that the components are in electrical communication with each other. The processor or central control unit may be configured for controlling electrical energy provided by the battery power source to the motor. The processor is configured for providing a first rate of electrical energy, a second rate of electrical energy and a third rate of electrical energy. The higher the rate of electrical energy the faster the propeller will rotate and the higher the amount of thrust or power that may be provided by the propeller. In one embodiment, the first rate of electrical energy is higher than the second rate of electrical energy, and the second rate of electrical energy is higher than the third rate of electrical energy. In one embodiment, the first rate of electrical energy, second rate of electrical energy, and third rate of electrical energy may vary depending on the application or user preference. It is also understood that additional or less rates of energy may be provided to provide additional or less speeds by the handheld propulsion unit. In one embodiment, rates of speed for the unit or speed will correspond to the rates of electrical energy provided by the battery. For example, for the highest speed, the highest rate of electrical energy will be provided by the battery. In one embodiment, the highest rate of speed will be the maximum amount of electrical energy (100%) that the battery or battery power source may provide to the motor. In one embodiment, for the middle rate of speed, a rate of electrical energy provided by the battery to the electric motor may be 75% percent of the maximum amount that the battery or battery power source. In one embodiment, for the low speed, a rate of electrical energy provided by the battery to the electric motor may be 10% percent of the maximum amount of electrical energy that may be provided by the battery power source or battery to the motor.

In one embodiment, the processor is configured to monitor the amount of electrical energy remaining in the battery by a sensor 610. In one embodiment, the unit may also provide a "limp mode" that may be used when the amount of electrical energy remaining in the motor reaches a low or critical state. In order to provide the limp mode, the processor may be configured for providing a rate of electrical energy that is lower than the rate of electrical energy used for producing the low rate of speed, In such an embodiment, the processor is further configured to provide the rate of electrical energy for producing the limp mode if the processor determines that a threshold minimum amount of electrical energy remains in the battery power source. In one embodiment, the threshold minimum amount of electrical energy may be approximately about fifteen (15%) percent of a maximum amount of electrical energy that the battery power source is configured to hold. In one embodiment, the rate of electrical energy provided during the limp mode is approximately ten percent (10%) of the electrical energy provided during the first rate of electrical energy. In another embodiment, the threshold minimum amount of electrical energy is approximately at most twenty five percent (25%) percent of a maximum amount of electrical energy that the battery power source is configured to hold. In another embodiment, the rate of electrical energy provided during a limp mode may be at most approximately twenty five percent (25%) of the electrical energy provided during the high speed mode. The limp mode is configured for providing a rate of speed indicator to signify that the amount of electrical energy remaining in the battery is running low. The rate of speed indicator notifies the user by providing a motion indicator because the speed of the unit will suddenly drop to a lower speed than even the low speed. However, it is understood that the other rates may be programmed and are within the spirit and scope of the present invention.

The electrical circuitry, including the processor that is communication with battery power source, motor and knobs is further configured to provide electrical energy from the battery source or battery to the electric motor only if continuous force acts on the both knobs causing both knobs 135 to remain in an engaged position. In operation, a user must the depress both of the knobs at the same time and cause both knobs to remain in the engaged position in order to activate the motor to rotate the propeller. This acts as a safety feature because a person must have both hands grasping the hand grips in order to operate the handheld propulsion unit, which prevents a person from accidentally placing a finger or thumb into the path of a rotating propeller.

The processor 605 is further configured moving between the first rate of electrical energy, the second rate of electrical energy, the third rate of electrical energy when the processor detects a short pause of the continuous force from only one of the knobs 135 after the continuous force has been acting on both knobs. As mentioned above, knobs 135 protrudes from the handgrips 125 and are configured for being engaged by the user. The knobs or knob assembly may include an outwardly biasing element or spring that pushes the knob outward and into a disengaged position so that unless forces act on the knob to move the knob into the engaged position the knobs will be in the disengaged position. However, it is understood that other controls that may be engaged by a user's hands may be used and are within the spirit and scope of the present invention. The processor or central control unit 605 is further configured to provide electrical energy from the battery source to the electric motor only if continuous force acts on both first knobs at the same time causing both knobs to remain in an engaged position. This is a safety feature that requires a user to hold the unit with both hands and engage both knobs in order to cause electrical energy to move from the battery power source to motor causing the propeller to spin. In operation, a user will have to use a thumb or digit to apply force to both of the knobs at the same time in order to cause the propeller to spin. If user removes force from either of the knobs, the biasing element moves the knob outward and into to the disengaged position. When either of the knobs remain in the disengaged position, then the processor is configured prevent electrical energy from powering the propeller and causing the propeller to not spin.

The processor may also be configured moving between the first rate of electrical energy, the second rate of electrical energy, the third rate of electrical energy when it detects a short pause of the continuous force from only one of the knobs after the continuous force has been acting on both knobs. The processor is also configured for moving from between the rates of electrical energy provided by the battery to the motor after determining that a short pause on one of the buttons has occurred. For example, in operation, the user may apply force to both knobs (greater than the outward force provided by the spring or biasing element) so that both knobs move from the disengaged configuration into the engaged configuration. As a result, the processor will provide electrical energy from battery power source to the motor and turn the propeller at a certain rate of speed. The central control unit may be programmed so that the initial speed is the highest speed or the lowest speed when the user initially engages both buttons so that both buttons remain in the engaged configuration. If the programming is such that the initial speed is the lowest speed, then when the user first applies force to both knobs, the rate of speed or electrical energy provided by the battery to the electric motor will be the lowest rate of speed. If the user desires to change the speed or thrust provided by the unit, then the user may stop applying force to one of the buttons so that the biasing force of the spring or biasing element moves the button outward and into the disengaged configuration for a brief amount of time, providing a short pause of the continuous force, and then reapply force to the button so that the button moves back into and remains in the engaged configuration. The amount of time for the short pause may vary based on the application. In one embodiment, the pause may be from 0.25 sec to 2 sec. However, it is understood that other embodiments of the short pause may be within the spirit and scope of the present invention. The processor, after determining that a short pause on one of the buttons has occurred, will change from the rate of electrical energy provided by the battery to the motor to the middle rate of speed. If the user is currently at the middle rate of speed and the user desires to move from the middle speed or electrical energy provided by the battery power source to the highest speed or electrical energy provided by the battery power source, then the user would again stop applying force on one of the buttons so that the biasing force of the spring moves the button or knob outward and into the disengagement configuration for a brief amount of time, providing a short pause of the continuous force, and then reapply force to the button or knob so that the button moves back into and remains in the engaged configuration. The processor, after determining that a short pause on one of the buttons has occurred, will change from the rate of electrical energy provided by the battery to the motor to the high rate of speed. If the user is currently at the high rate of speed and the user desires to move from the high speed or electrical energy provided by the battery power source to the lowest speed or electrical energy provided by the battery power source, then the user would again stop applying force to one of the buttons or knobs so that the biasing force of the spring or biasing element moves the button outward and into the disengagement configuration for a brief amount of time, providing a short pause of the continuous force, and then reapply force to the button or knob so that the button moves back into and remains in the engaged configuration. The processor, after determining that a short pause on one of the buttons has occurred, will change from the rate of electrical energy provided by the battery to the motor to back to the low rate of speed. The central control unit may be programmed so that the initial speed is the highest speed when the user initially engages both buttons so that both buttons are in the engaged configuration. Additionally, it is understood that the processor may include programming so that a variety of different methods of changing between rates of speed may be used, which are within the spirit and scope of the present invention.

Still referring to FIG. 6, as mentioned the battery or battery power source 610 may be positioned within the tubular shaped housing assembly. The battery power source may be a solar powered battery, rechargeable battery, non-rechargeable, lithium, a battery pack, lithium-ion, smart battery etc. or any combination thereof. The battery power source may be easily removable from a cavity that may be accessed from the outward facing surface of the housing. In one embodiment, the processor is configured to monitor the amount of electrical energy remaining in the battery or the state of the charge by a sensor 610. The sensor may be a variety of types of sensors or monitoring systems and may include a voltmeter, hydrometer, state of charge gauge, low power monitoring circuit sensor, etc. The sensor may also monitor other data and may also include other devices capable of monitoring other data and may include a temperature sensor, a conductance measurement device, a barometer, a pressure sensor, etc. The sensor may be a single sensor or multiple sensors and may be positioned in a variety of different configurations.

FIG. 6 also illustrates that the handheld propulsion unit may only have one small frame member 130 housing a conductor 570 providing conductive communication between the motor and the remaining components of the electrical circuitry of the unit. FIG. 6 further illustrates that the unit may be configured to not include the belt and drive casing disclosed by Mayhem. As discussed above, the belt and housing taught by Mayhem may be very inefficient, noisy, heavy and as a result not cost effective. As a result, of not having to house the belt or drive transfer assembly, the amount of the area in front of the channel not interrupted by a housing or drive transfer assembly is increased and as a result, the operating efficiency of the unit is increased.

Figure 7:
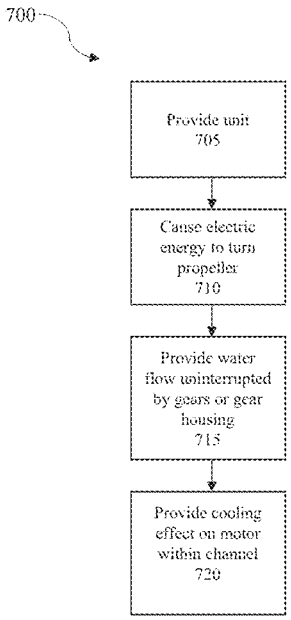
FIG. 7 is a flowchart illustrating steps related to the process of providing a cooling effect on the electric motor, according to an example embodiment.

Referring to FIG. 7, FIG. 7 is a flowchart illustrating steps related to the process 700 of propelling a user in and under water, according to an example embodiment. First, in step 705, the process includes providing a handheld propulsion unit. The handheld propulsion unit is similar to the embodiments described in FIGS. 1-6. Referring to FIGS. 1-6, the handheld propulsion unit includes a tubular shaped housing assembly 105 having a forward end 110 and an opposing rearward end 115. A channel 150 is defined by the tubular shaped housing assembly for allowing a flow of water to move through the tubular shaped housing assembly. At least one frame member 130 is positioned to the tubular shaped housing and attaches an electric motor (see stationary part 560 and rotating part 565 of electric motor in FIG. 5A electric motor 604 in FIG. 6) within the channel 150 such that the rotational axis (repenetrated by line B in FIGS. 5 and 5A) of the electric motor is coaxially aligned with the longitudinal axis of the channel (repenetrated by line A in FIGS. 5 and 5A). A propeller 310 is coaxially coupled directly to a rotating part of the electric motor (see, e.g., 565 FIG. 5A) thereby eliminating at least one of a drive transfer assembly and a drive transfer housing within the channel. The handheld propulsion unit may also be configured such that the tubular shaped housing assembly 105 defines hand grips 125 on an outward facing wall of tubular shaped housing assembly. The hand grips are configured for being held by the user and allowing the user to maneuver a thrust provided by the flow of water through the channel when the propeller is operating. The body of the tubular shaped housing assembly may be hollow inside or may have cavities therein which are configured for housing various components for providing electrical energy to the motor, such as a battery or removable battery, electrical circuitry, processors, etc. For example, in the present embodiment the rearward end of the housing has a cavity defining a space to house the battery that is covered by a lockable door 220. As mentioned above, knobs or buttons 135 protrudes from the handgrips and are configured for being engaged by the user into an engaged positioned. The knobs or entire knob assembly may include an outwardly biasing element or spring that pushes the knob outward and into a disengaged position. The processor or central control unit 605 is further configured to provide electrical energy from the battery source to the electric motor only if continuous force acts on both knobs at the same time causing both knobs to remain in an engaged position. This is a safety feature that requires a user to hold the unit with both hands and engage both knobs in order to cause electrical energy to move from the battery power source to motor causing the propeller to spin. In operation, a user will have to use a thumb or digit to apply force to both of the knobs at the same time in order to cause the propeller to spin. If user removes force from either of the knobs, the biasing element or spring of the knob or knob assembly moves the knob to the disengaged position. When either of the knobs remain in the disengaged position, then the processor is configured to prevent electrical energy from powering the propeller and causing the propeller to not spin.

Next, in step 710, the process includes causing electrical energy to activate the electric motor causing the propeller to spin such that water moves into the channel uninterrupted by the at least one of drive transfer assembly and drive transfer housing. As mentioned above, when the user causes force to be applied to both the knobs to move inward, the processor or central control unit causes electrical energy to move from the battery power source 610 to activate the electric motor causing the propeller to spin such that water moves into the channel uninterrupted by the at least one of drive transfer assembly and drive transfer housing.

Next, in step 720, the flow of water through the channel 150 directly contacts the electric motor within the channel and provides a cooling effect on the electric motor. As mentioned above, the electric motor has a stationary portion 560 attached to the frame element 130 within the channel. The cooling effect on the motor may be defined as causing heat produced by the motor to be transferred to the outside environment. The flow water contacting the electric motor or electric motor housing causes the cooling effect. Additionally, because the unit does not have a drive transfer assembly or drive transfer housing water moving into the channel is not affected by the larger housings that interrupt the water flow into the channel. The process further prevents noise or sound caused by drive transfer systems, which may scare away fish and other marine life when the unit is in operation.

Figure 8:
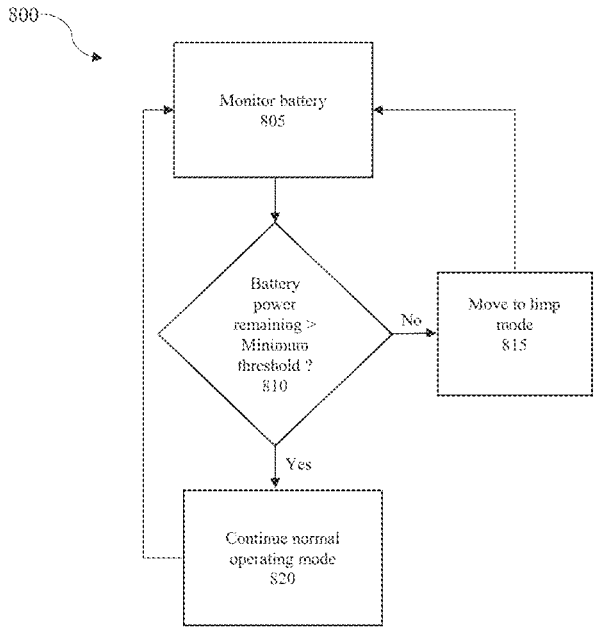
FIG. 8 is a second flowchart illustrating steps related to the process of providing a limp mode, according to an example embodiment.

FIG. 8 is a second flowchart illustrating steps related to the process of propelling a user in and under water, according to an example embodiment. The process 805 illustrates the limp mode that may be provided by the unit. As mentioned above, the central control unit or processer 605 may be configured for monitoring the remaining charge for electrical energy remaining in the battery or battery power source 610. In step 805, the processor may monitor battery to determine if a threshold minimum amount of energy remains in the battery power source. As mentioned above, in one embodiment, the threshold minimum amount of electrical energy may be approximately about fifteen (15%) percent of a maximum amount of electrical energy that the battery power source is configured to hold. In another embodiment, the threshold minimum amount of electrical energy is approximately is at most twenty five percent (25%) percent of a maximum amount of electrical energy that the battery power source is configured to hold. The limp mode is configured for providing a rate of speed indicator to signify that the amount of electrical energy remaining in the battery is running low. However, it is understood that the other rates may be programmed and are within the spirit and scope of the present invention.

Next, in step 810, the processor or central control unit is configured for determining if the threshold minimum amount of electrical energy remains in the battery power source. If the threshold minimum amount of energy is greater than the minimum threshold, then the processor is configured for continuing in the normal operating mode (at high speed, middle speed or low-speed) (as illustrated in step 820). On the other hand, if the threshold minimum amount of energy is less than the minimum threshold, then the processor is automatically configured for moving the unit into the limp mode (as illustrated in step 815). In step 815, in one embodiment, the rate of electrical energy provided during the limp mode is approximately ten percent (10%) of the electrical energy provided during the first rate of electrical energy or high-speed mode. In one embodiment, the rate of electrical energy provided during the limp mode may be at most approximately twenty five percent (25%) of the electrical energy provided during the first rate of electrical energy or high speed mode.

Figure 9:
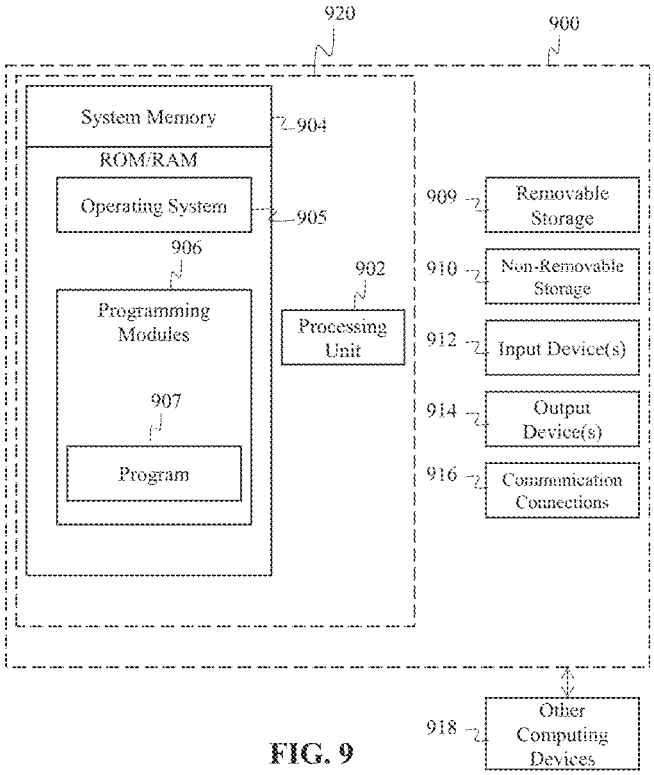
FIG. 9 is a block diagram of an example computing device, processor or central control unit and other computing devices, according to an example embodiment.

FIG. 9 is a block diagram of a system including an example central control unit or computing device 900 and other computing devices. Consistent with the embodiments described herein, the aforementioned actions performed by processor or central control unit 605 may be implemented in a computing device, such as the computing device 900 of FIG. 9. Any suitable combination of hardware, software, or firmware may be used to implement the computing device 900. The aforementioned system, device, and processors are examples and other systems, devices, and processors may comprise the aforementioned computing device. Furthermore, computing device 900 may comprise an operating environment for the methods and processes shown in FIGS. 7 and 8 above as well as other processes that may be within the spirit and scope of the present invention.

With reference to FIG. 9, a system consistent with an embodiment of the invention may include a plurality of computing devices, such as computing device 900. In a basic configuration, computing device 900 may include at least one processing unit 902 and a system memory 904. Depending on the configuration and type of computing device, system memory 904 may comprise, but is not limited to, volatile (e.g. random access memory (RAM)), non-volatile (e.g. read-only memory (ROM)), flash memory, or any combination or memory. System memory 904 may include operating system 905, one or more programming modules 906 (such as program module 907). Operating system 905, for example, may be suitable for controlling computing device 900's operation. In one embodiment, programming modules 906 may include, for example, a program module 907. Furthermore, embodiments of the invention may be practiced in conjunction with a graphics library, other operating systems, or any other application program and is not limited to any particular application or system. This basic configuration is illustrated in FIG. 9 by those components within a dashed line 920.

Computing device 900 may have additional features or functionality. For example, computing device 900 may also include additional data storage devices (removable and/or non-removable) such as, for example, magnetic disks, optical disks, or tape. Such additional storage is illustrated in FIG. 9 by a removable storage 909 and a non-removable storage 910. Computer storage media may include volatile and nonvolatile, removable and non-removable media implemented in any method or technology for storage of information, such as computer readable instructions, data structures, program modules, or other data. System memory 904, removable storage 909, and non-removable storage 910 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 900. Any such computer storage media may be part of device 900. Computing device 900 may also have input device(s) 912 such as a keyboard, a mouse, a pen, a sound input device, a camera, a touch input device, etc. Output device(s) 914 such as a display, speakers, a printer, etc. may also be included. The aforementioned devices are only examples, and other devices may be added or substituted.

Computing device 900 may also contain a communication connection 916 that may allow device 900 to communicate with other computing devices 918, such as over a network in a distributed computing environment, for example, an intranet or the Internet. Communication connection 916 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 904, including operating system 905. While executing on processing unit 902, programming modules 906 may perform processes including, for example, one or more of the methods shown in FIGS. 7 and 8 above. Computing device 902 may also include a graphics processing unit 903, which supplements the processing capabilities of processor 902 and which may execute programming modules 906, including all or a portion of those processes and methods shown in FIGS. 7 and 8 above. The aforementioned processes are examples, and processing units 902, 903 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A handheld propulsion unit for use by a user in and under water, the handheld propulsion unit comprising:

a tubular shaped housing assembly having a forward end and an opposing rearward end;

a channel defined by the tubular shaped housing assembly for allowing a flow of water to move through the tubular shaped housing assembly;

at least one frame member connected to the tubular shaped housing and attaching an electric motor within the channel such that the electric motor is coaxially aligned with the channel and such that the entire electric motor is substantially between the forward end and the rearward end of the tubular shaped housing;

a propeller coaxially coupled directly to a rotating part of the electric motor thereby eliminating at least one of a drive transfer assembly and a drive transfer housing spanning the channel; and, the tubular shaped housing assembly defining a first hand grip on a first side and a second hand grip on a second side of an outward facing wall of tubular shaped housing assembly, the first hand grip and second hand grip are configured for being held by the user and allowing the user to maneuver a thrust provided by the flow of water through the channel when the propeller is operating.

2. The handheld propulsion unit of claim 1, wherein a removable battery power source in electrical communication with the electric motor is housed in the tubular shaped housing assembly.

3. The handheld propulsion unit of claim 1, wherein a stationary portion of the electric motor is attached to the at least one frame member within the channel, and wherein the flow of water through the channel contacts the electric motor and provides a cooling effect on the electric motor.

4. The handheld propulsion unit of claim 1, wherein the tubular shaped housing assembly is further configured for housing electrical circuitry and a processor in electrical communication with the electric motor and the battery power source, wherein the processor is configured for controlling electrical energy provided by the battery power source to the motor, and wherein the processor is configured for providing a first rate of electrical energy, a second rate of electrical energy and a third rate of electrical energy, the first rate of electrical energy being higher than the second rate of electrical energy and the second rate of electrical energy being higher than the third rate of electrical energy.

5. The handheld propulsion unit of claim 4, wherein the processor is configured for providing a fourth rate of electrical energy being lower than the third rate of electrical energy, wherein the processor is further configured to provide the fourth rate of electrical energy if the processor determines that a threshold minimum amount of electrical energy remains in the battery power source.

6. The handheld propulsion unit of claim 5, wherein the threshold minimum amount of electrical energy is approximately is at most twenty five percent (25%) percent of a maximum amount of electrical energy that the battery power source is configured to hold, and wherein the fourth rate of electrical energy is at most approximately twenty five percent (25%) of the electrical energy provided during the first rate of electrical energy.

7. The handheld propulsion unit of claim 6, wherein the processor is further configured moving between the first rate of electrical energy, the second rate of electrical energy, the third rate of electrical energy by a short pause of the continuous force from only one of the first knob or second knob after the continuous force has been acting on both first knob and second knob.

8. The handheld propulsion unit of claim 1, wherein a first knob protrudes from the first handgrip and a second knob protrudes from the second handgrip, the first knob and second knob are configured for being engaged by the user.

9. The handheld propulsion unit of claim 8, wherein the processor is further configured to provide electrical energy from the battery source to the electric motor only if continuous force acts on the first knob and the second knob causing both first knob and the second knob to remain in an engaged position.

10. The handheld propulsion unit of claim 1, wherein electric motor positioned within the channel provides a substantially uninterrupted intake flow path for water flowing into the channel except for the at least one frame member when the propeller is operating.

11. A handheld propulsion unit for use by a user in and under water, the handheld propulsion unit comprising:

a tubular shaped housing assembly having a forward end and an opposing rearward end;

a channel defined by the tubular shaped housing assembly for allowing a flow of water to move through the tubular shaped housing assembly;

a forward ribbing spanning a forward end of channel and a rearward ribbing spanning a rearward end of the channel;

an electric motor coaxially aligned with the channel and such that the entire electric motor is substantially between the forward end forward end and the rearward end of the tubular shaped housing;

a propeller coaxially aligned with the channel, positioned between the forward ribbing and rearward ribbing and coaxially aligned and coupled directly to a rotating part of the electric motor thereby eliminating at least one of a drive transfer assembly and drive transfer housing from spanning the forward end of the channel;

the tubular shaped housing assembly defining a first hand grip on a first side and a second hand grip on a second side of an outward facing wall of tubular shaped housing assembly, the first hand grip and second hand grip are configured for being held by the user and allowing the user to maneuver a thrust provided by the flow of water through the channel when the propeller is operating;

a first knob protruding from the first handgrip and a second knob protruding from the second handgrip, the first knob and second knob are configured for being engaged by the user; and, a processor and electrical circuitry, housed within the tubular shaped housing, and in electrical communication with the electric motor and the battery power source, wherein the processor is configured for controlling electrical energy provided by the battery power source to the motor, and wherein electrical energy from the battery source to the electric motor is provided only if continuous force acts on the first knob and the second knob causing both first knob and the second knob to remain in an engaged position.

12. The handheld propulsion unit of claim 11, wherein a stationary portion of an electric motor is attached to the forward ribbing within the channel, and wherein the flow of water through the channel directly contacts the electric motor and provides a cooling effect on the electric motor.

13. The handheld propulsion unit of claim 12, wherein the processor is configured for providing a fourth rate of electrical energy being lower than the third rate of electrical energy, wherein the processor is further configured to provide the fourth rate of electrical energy if the processor determines that a threshold minimum amount of electrical energy remains in the battery power source.

14. The handheld propulsion unit of claim 13, wherein the threshold minimum amount of electrical energy is approximately about fifteen (15%) percent of a maximum amount of electrical energy that the battery power source is configured to hold, and wherein the fourth rate of electrical energy is approximately ten percent (10%) of the electrical energy provided during the first rate of electrical energy.

15. The handheld propulsion unit of claim 11, wherein the processor is further configured moving between the first rate of electrical energy, the second rate of electrical energy, the third rate of electrical energy by a short pause of the continuous force from only one of the first knob or second knob after the continuous force has been acting on both first knob and second knob.

16. A method of propelling a user in and under water, wherein the method comprises:

a. providing a handheld propulsion unit, wherein handheld propulsion unit comprises:

a tubular shaped housing assembly having a forward end and an opposing rearward end;

a channel defined by the tubular shaped housing assembly for allowing a flow of water to move through the tubular shaped housing assembly;

at least one frame member connected to the tubular shaped housing and attaching an electric motor within the channel such that the electric motor is coaxially aligned with the channel and such that the entire electric motor is substantially between the forward end and the rearward end of the tubular shaped housing;

a propeller coaxially coupled directly to a rotating part of the electric motor thereby eliminating at least one of a drive transfer assembly and a drive transfer housing from spanning the channel; and, the tubular shaped housing assembly defining a first hand grip on a first side and a second hand grip on a second side of an outward facing wall of tubular shaped housing assembly, the first hand grip and second hand grip are configured for being held by the user and allowing the user to maneuver a thrust provided by the flow of water through the channel when the propeller is operating;

b. causing electrical energy to activate the electric motor causing the propeller to spin such that water moves into the channel uninterrupted by the at least one of the drive transfer assembly and drive transfer housing.

17. The method of claim 16, wherein the method further includes providing a cooling effect on the electrical motor positioned within the channel when the flow of water through the channel contacts the electric motor.

18. The method of claim 16, wherein the method further comprises providing to the electric motor a lower rate of electrical energy than at least one operating rate of electrical energy if a threshold minimum amount of electrical energy remains in the battery power source.

19. The method of claim 18, wherein the threshold minimum amount of electrical energy is approximately is at most twenty five percent (25%) percent of a maximum amount of electrical energy that the battery power source is configured to hold, and wherein the lower rate of electrical energy is at most approximately twenty five percent (25%) of the electrical energy provided during at least one operating rate of electrical energy.

* * * * *